US009682403B2

(12) United States Patent
Ito et al.

(10) Patent No.: US 9,682,403 B2
(45) Date of Patent: Jun. 20, 2017

(54) METHOD FOR THE SPOT REPAIR OF SCRATCH-RESISTANT PAINT FILMS

(75) Inventors: Takehito Ito, Tokyo (JP); Tsutomu Shimamura, Yokohama (JP); Makito Monden, Kanagawa (JP)

(73) Assignee: BASF Japan Ltd., Tokyo (JP)

( * ) Notice: Subject to any disclaimer, the term of this patent is extended or adjusted under 35 U.S.C. 154(b) by 479 days.

(21) Appl. No.: 13/499,312

(22) PCT Filed: Aug. 2, 2010

(86) PCT No.: PCT/IB2010/001952

§ 371 (c)(1),
(2), (4) Date: Jun. 8, 2012

(87) PCT Pub. No.: WO2011/039581

PCT Pub. Date: Apr. 7, 2011

(65) Prior Publication Data

US 2012/0269964 A1 Oct. 25, 2012

(30) Foreign Application Priority Data

Sep. 30, 2009 (JP) ..... 2009-226285

(51) Int. Cl.

| | |
|---|---|
| ***B05D 3/12*** | (2006.01) |
| ***B05D 5/00*** | (2006.01) |
| *B05D 7/00* | (2006.01) |
| *B05D 1/36* | (2006.01) |

(52) U.S. Cl.

CPC ..... *B05D 5/005* (2013.01); *B05D 7/532* (2013.01); *B05D 1/36* (2013.01); *B05D 3/12* (2013.01); *B05D 7/56* (2013.01); *B05D 7/57* (2013.01)

(58) Field of Classification Search

CPC ..... B05D 5/00; B05D 2505/00; B05D 3/067; B05D 7/532; B05D 7/566; B05D 7/567; B05D 7/57; B05D 5/005; B05D 7/56; B05D 7/58; B05D 1/36; B05D 1/38; B05D 3/12; C09D 7/001

USPC ..... 427/140

See application file for complete search history.

(56) References Cited

U.S. PATENT DOCUMENTS

| | | | | |
|---|---|---|---|---|
| 4,960,558 | A * | 10/1990 | Short | 264/510 |
| 5,683,745 | A * | 11/1997 | Liedtke et al. | 427/140 |
| 6,872,765 | B1 * | 3/2005 | Betz et al. | 524/261 |
| 2004/0101628 | A1 * | 5/2004 | Schneider et al. | 427/407.1 |
| 2004/0214942 | A1 * | 10/2004 | Huybrechts et al. | 524/507 |
| 2005/0093947 | A1 * | 5/2005 | Maekawa | B41M 5/0256 347/100 |
| 2007/0190257 | A1 * | 8/2007 | Huynh-Ba et al. | 427/407.1 |
| 2008/0027154 | A1 * | 1/2008 | Ramsey | A01N 59/14 522/7 |
| 2009/0017199 | A1 | 1/2009 | Kotyakov | |

FOREIGN PATENT DOCUMENTS

| | | | | |
|---|---|---|---|---|
| CN | 101234378 | A | 8/2008 | |
| DE | 4329897 | A1 | 3/1995 | |
| DE | 19914896 | A1 * | 10/2000 | |
| JP | 07118605 | | 5/1995 | |
| JP | 2001058156 | A | 3/2001 | |
| JP | WO 2006109179 | A1 * | 10/2006 | C08G 18/6237 |
| JP | 2007169526 | A * | 7/2007 | |

OTHER PUBLICATIONS

DE 19914896 A1, Haeberle K et al., Oct. 2000, machine translation.*

Military Handbook—MIL-HDBK-1110: Handbook for Paints and Protective Coatings for Facilities, U.S. Department of Defense, Jan. 17, 1995, p. 153.*

Dow, "Product Safety Assessment", Jun. 23, 2009, p. 1-6.*

JP 2007-169526 A, Machine Translation, originally published 2007, p. 1-22.*

DoItYourself, "A Complete Guide to Sandpaper Grit Classification", 2015, p. 1-3.*

International Search Report for International Application No. PCT/IB2010/001952 mailed Nov. 25, 2010, 3 pages.

Written Opinion of the International Searching Authority for International Application No. PCT/IB2010/001952 mailed Nov. 25, 2010, 4 pages.

International Preliminary Report on Patentability of the International Searching Authority for International Application No. PCT/IB2010/001952 mailed Apr. 12, 2012, 4 pages.

Goldschmidt, Artur et al., "BASF Handbook on Basics of Coating Technology", 2007, 6 pgs.

* cited by examiner

*Primary Examiner* — Katherine A Bareford
*Assistant Examiner* — Christina McClure
(74) *Attorney, Agent, or Firm* — Servilla Whitney LLC

(57) ABSTRACT

A spot repair method of scratch-resistant paint film: (a) sanding a part to be repaired having a scratch-resistant clear paint film thereon, (b) sanding a part to be clear gradation painted outside the part to be repaired with an abrasive material, (c) painting the part to be repaired with a color base-paint, (d) applying a clear paint wet-on-wet without curing the color base-paint, (e) applying a clear paint diluted with a gradation agent to the part to be gradation painted, (f) drying the applied paints, and (g) polishing the dried parts, wherein (1) the clear paint is a two-liquid type having an isocyanate curing agent and (2) the gradation agent comprises from 5 to 50 mass % ethyl ethoxypropionate, from 1 to 5 mass % of an acrylic resin as solid fraction, a surfactant and a curing catalyst.

5 Claims, No Drawings

METHOD FOR THE SPOT REPAIR OF SCRATCH-RESISTANT PAINT FILMS

CROSS REFERENCE TO RELATED APPLICATIONS

This application is a National Phase Application of Patent Application PCT/IB2010/01952 filed on 2 Aug. 2010, which claims priority to JP 2009-226285, filed 30 Sep. 2009, both of which are hereby incorporated by reference in their entirety.

FIELD OF THE INVENTION

The present invention concerns a method for the spot repair of scratch-resistant paint films. More precisely, the invention concerns a method for the spot repair of scratch-resistant clear paint films of automobile bodies and the like with which mist outside the part which is the subject of the repair is polished off easily and with which peeling of the thin film part of the clear paint film is not liable to occur, and with which it is possible to obtain an appearance where it is difficult to find the boundary line between the spot repair part and the unrepaired part.

BACKGROUND OF THE INVENTION

When abnormalities such as peeling, discoloration, scratching or the like arise in the paint films on automobile bodies or the like they are repaired using repair paint materials. Automobile repairs can be broadly classified as edge to edge repairs and spot repairs. Edge to edge repairs are carried out when the part which is to be repaired is comparatively large and when repairing the center portion of an automobile part, and the whole of the part is painted with the repair paint. On the other hand spot repair is carried out when the part which is to be repaired is small or when the location of the part to be repaired is not in a prominent position.

In general, spot repairs involve sanding the part which is to be repaired, painting the surface as required and drying and then sanding again and applying the top paint. In this partial painting process, gradation painting is carried out with the clear paint so that the appearance of the unrepaired part does not show a discontinuity from the part which is the subject of the repair. Gradation painting with the clear paint is a process in which clear paint which has been over-diluted with thinner, a liquid mixture of gradation agent and clear paint, or just the gradation agent itself, is applied in the mist part in such a way that there is a gradient of paint film thickness from the repair part to the unrepaired part and in such a way that little mist is deposited on the surrounding part. After drying, the surrounding mist produced by the gradation painting with the clear paint is polished off by polishing. If the polishing in this polishing process is inadequate then the mist is not completely removed and if the polishing is too severe when removing the mist then the clear paint peels away at the boundary line and there is a problem in that a trace of the repair remains. Thus, the gradation painting and polishing processes are processes which require the person completing the repair to be highly skilled.

On the other hand, in many cases a scratch-resistant clear paint which is not prone to scratching by the rubbing forces which are imposed by car washing brushes and the like is applied for the top coat paint film which is coated on an automobile body or the like. Scratch-resistant paint films are either of the type where the paint film is harder than a conventional clear paint film and not liable to scratching or of the re-flow type which is temporarily deformed by the rubbing force of a brush or the like and then immediately reverts to its original form. With both types of scratch-resistant clear paint film the process of polishing off the mist in the spot repair of the repair clear paint film is difficult because of the non-scratch nature, and there is a problem in that a polishing process of long duration is required to polish off the mist. Furthermore, peeling of the clear paint film at the repair boundary line due to the excessive polishing occurs with such scratch-resistant clear paint films, the boundary line between the repair part and the unrepaired part is revealed and there is a problem in that a continuous appearance is not obtained.

In order to deal with these problems there is disclosed in Japanese unexamined patent application laid open H7-118605, for example, a technique in which both scratch resistance and polishability are provided by using a specified paint composition for the top coat. However, although the scratch resistance and the polishability of the part which is the subject of the repair are improved with this technique, there is a weakness in that the polishability of the mist part outside the repaired part is unsatisfactory.

On the other hand, in recent years there has been a strong demand for the establishment of a method of repair which provides a continuous appearance where the boundary line between the repaired part and the unrepaired part cannot be distinguished when the scratch-resistant clear paint film on an automobile body or the like has been partially repaired.

Furthermore, a method in which a thinner for repair purposes which contains surfactant is applied has been disclosed as a method for the spot repair of paint films which enables the repair to carried out easily in such a way that the appearances of the repair part and the dust part surrounding the repair part are of the same the repair paint film (for example, see Japanese unexamined patent application laid open 2001-58156). However, with this method there is a weakness in that the appearance of the repair part and the unrepaired part is discontinuous when a scratch-resistant clear paint is repaired.

Furthermore, a grading liquid composition which contains (1) (A) acrylic resin which includes hydroxyethyl (meth) acrylate and an adduct of hydroxyethyl (meth)acrylate and ϵ-caprolactone and (B) resin which contains polycaprolactone polyol, (2) organic solvent which includes from 30 to 100 mass % of polar solvent of boiling point from 120 to 230° C., in proportions (by mass) of (1)/(2) of from 1/99 to 5/95, and (3) dibutyltin dilaurate in an amount of from 0.03 to 0.05 parts by mass per 100 parts by mass of the solid fraction of the grading liquid composition has been disclosed as a grading liquid composition which can provide excellent scratch resistance and coated film cut resistance in the repair part and the part surrounding the repair part of an automobile outer paint film (for example, see Japanese unexamined patent application laid open 2007-169526). However, in this case there is a weakness in that the smoothness of the paint film is lost with the use of the ϵ-caprolactone adduct which is of high polarity.

The present invention is intended to provide a method for the spot repair of scratch-resistant paint films which are scratch-resistant clear paint films on an automobile body or the like, with which mist outside the part which is the subject of the repair is polished off easily and with which peeling of the thin film part of the clear paint film is not liable to occur, and with which it is possible to obtain an appearance where it is difficult to find the boundary line between the repaired part and the unrepaired part.

The present inventors have discovered as a result of thorough research carried out with a view to realizing the aforementioned aim that the intended aims can be achieved by means of a method of repair which includes specified processes, and the present invention is based upon this discovery.

SUMMARY OF THE INVENTION

That is to say, the present invention is:

[1] A method for the spot repair of a scratch-resistant paint film which includes (a) a process in which the part which is the subject of the repair whereon a scratch-resistant clear paint film has been coated is sanded, (b) a process in which the part which is to be clear gradation painted outside the part which is the subject of the repair is sanded with an abrasive material, (c) a process in which the part which is the subject of the repair is painted with a color base-paint, (d) a process in which a clear paint is applied wet-on-wet without curing the color base-paint, (e) a process in which clear paint which has been diluted with a gradation agent is applied to the part which is to be gradation painted, (f) a drying process and (g) a process in which the parts which have been gradation painted are polished, characterized in that (1) the aforementioned clear paint is a paint of the two-liquid type of the isocyanate curing type, and (2) the aforementioned gradation agent includes a solvent which includes ethyl ethoxypropionate, acrylic resin, surfactant and curing catalyst and the amount of ethyl ethoxypropionate in the gradation agent is from 5 to 50 mass % and the acrylic resin content as solid fraction is from 1 to 5 mass %.

[2] The method for the spot repair of a scratch-resistant paint film claimed in [1] above in which a process in which a clear paint which has been diluted with diluting solvent is applied is established as a process (d') between process (d) and process (e).

[3] The method for the spot repair of a scratch-resistant paint film claimed in [1] or [2] above in which the acrylic resin which is included in the gradation agent has from 5 to 50 mass % acrylic ester copolymerizable monomer units which have from 8 to 10 carbon atoms in the molecule.

By means of the present invention it is possible to provide a method for the spot repair of a scratch-resistant paint film, which is a method for the spot repair of the scratch-resistant clear paint film of an automobile body or the like, with which the mist outside the part which is the subject of the repair can be polished off easily and with which peeling of the thin film part of the clear paint film is not liable to occur, and with which it is possible to obtain an appearance such that the boundary line between the spot repair part and the unrepaired part is difficult to find.

DETAILED DESCRIPTION OF A PREFERRED EMBODIMENT OF THE INVENTION

Next, the method for the spot repair of a scratch-resistant paint film of this invention will be described.

The method for the spot repair of a scratch-resistant paint film of this invention (hereinafter referred to more simply as the method of spot repair) is characterized by including the processes (a), (b), (c), (d), (e), (f) and (g) outlined below.

[Process (a)]

Process (a) in the method of spot repair of this invention is a process in which the part which is the subject of the repair on which scratch-resistant paint has been painted is sanded.

In recent years clear paints which have excellent scratch resistance such as that shown in Japanese Unexamined Patent Application Laid Open 2006-291111 for example have been used for the outermost paint films on automobiles and the like.

No particular limitation is imposed on the abrasive material for the repair part when the clear paint film is being repaired, but the use of a #400 to #1000 coarse abrasive material is preferred. Either water sanding or air sanding may be selected in the process where this sanding is being performed.

[Process (b)]

Process (b) in the method of spot repair of this invention is a process in which the part which is to be clear gradation painted on the outside of the part which is the subject of the repair is finely sanded with an abrasive material.

Finer sanding than in the repair part is desirable for the sanding of the part outside the part which is the subject of the repair. For example, a coarseness range from #1500 to #4000 is preferred for the abrasive material, and the range from #3000 to #4000 in particular is preferred since the sanding marks in the painted film are suppressed to the lowest level.

[Process (c)]

Process (c) in the method of spot repair of a scratch-resistant paint film of this invention is a process in which the part which is the subject of the repair is painted with a color base paint.

No particular limitation is imposed upon the color base paint when painting the part which is the subject of the repair with a color base paint, and it may be a color base paint of the solvent type or a color base paint of the water-based type.

Furthermore, the curing system of the color base paint may be of the one-liquid type or of the two-liquid type where an isocyanate compound is used as a curing agent.

The color base paint is generally applied with a spray painting method such as air-spraying or the like.

[Process (d)]

Process (d) in the method of spot repair of a scratch-resistant paint film of this invention is a process in which a clear paint is applied wet-on-wet without curing the color base paint.

The painting of the clear paint wet-on-wet in the uncured state without curing the color base paint when applying the clear paint on top of the color base paint layer where the color base paint has been painted on the part which is the subject of the repair is advantageous economically.

A scratch-resistant clear paint is preferred for the clear paint which is used, and in this invention a two-liquid type clear paint for repair purposes of the isocyanate curing type is used. No particular limitation is imposed upon the type of resin used in the clear paint for repair purposes, and resins such as acrylic resins, polyester resins, alkyd resins, fluorinated resins and the like can be used.

The clear paint is generally applied by means of a spray painting method such as air-spraying or the like.

[Process (d')]

Process (d') in the method of spot repair of a scratch-resistant paint film of this invention is a process which can be used, as required, between the aforementioned process (d) and the process (e) described hereinafter, and it is a process in which clear paint which has been diluted with diluting solvent is applied.

In said process (d') clear paint which has been excessively diluted with diluting solvent may be applied in order to lessen the dip in the film thickness between the repair part and the unrepaired part. The diluting rate of the diluting solvent as the ratio by mass of the proportions of clear paint and diluting solvent is preferably from 100/50 to 100/100. If the diluting rate is less than 100/50 then the effect of lessening the dip in paint film thickness is slight, and if is more than 100/100 then it is possible that the paint film appearance will be poor.

[Process (e)]

Process (e) in the method of spot repair of a scratch-resistant paint film of this invention is a process in which clear paint which has been diluted with a gradation agent is applied to the part which is to be subjected to gradation painting.

The painting is carried out after mixing a gradation agent with the clear paint described earlier on the part which is to be gradation painted with the aim of making it difficult to discern the repair painted part.

The gradation agent which is used in this invention is a composition which contains organic solvent which includes ethyl ethoxypropionate as an essential component, acrylic resin, surfactant and curing catalyst.

(The Organic Solvent)

As well as the essential component ethyl ethoxypropionate, hydrocarbon solvents such as toluene, xylene, Solvesso 100, Solvesso 150 (trade names, aromatic naphtha-based solvents, produced by the Exxon Chemical Co.) and the like; alcohol-based solvents such as methanol, ethanol, n-propyl alcohol, isopropyl alcohol, n-butyl alcohol, isobutyl alcohol and the like; ester-based solvents such as ethyl acetate, butyl acetate, isobutyl acetate, methoxybutyl acetate and the like; ketone-based solvents such as acetone, methyl ethyl ketone, methyl isobutyl ketone and the like; and glycol ether-based solvents such as propylene glycol mono-methyl ether, propylene glycol mono-methyl ether acetate, propylene glycol mono-ethyl ether, propylene glycol mono-ethyl ether acetate, ethylene glycol mono-methyl ether, ethylene glycol mono-methyl ether acetate, ethylene glycol mono-ethyl ether acetate and the like can be cited as examples of the organic solvents which can be used in said gradation agent.

The amount of organic solvent included in the gradation agent is generally some 90 to 98 mass %, and preferably from 93 to 97 mass %.

The ethyl ethoxypropionate which has excellent dissolving properties which is used as an essential component among these organic solvents must be included in a proportion of from 5 to 50 mass % in the gradation agent. If the amount included is less than 5 mass % then satisfactory paint film smoothness is not obtained and if, on the other hand, the amount exceeds 50 mass % then the drying properties of the paint film are poor. From these points of view the preferred content is within the range from 10 to 45 mass %.

(The Acrylic Resin)

The acrylic resin which is used in said gradation agent in this invention has the effect of improving the polishability of the mist part in spray painting and is generally provided as a copolymer of ethylenic unsaturated monomers.

The acrylic resin which is included in said gradation agent must be included in an amount as solid fraction of from 1 to 5 mass % (in the case where the residue on heating of the acrylic resin is 50 mass %, from 2 to 10 parts by mass in 100 parts by mass of the gradation agent), and it is preferably included in an amount as solid fraction of from 1.5 to 4 mass %. In those cases where the amount of acrylic resin included in said gradation agent as a solid fraction is less than 1 mass % the leveling properties are inadequate and the polishability of the mist part is poor, and in those cases where it exceeds 5 mass % problems arise with the prominence of dust marks after drying.

The aforementioned acrylic resin can be obtained by means of a known method such as the radical copolymerization of ethylenic unsaturated monomers such as acrylic monomers and the like.

The hydroxyl group value of the acrylic resin is preferably from 50 to 200 mgKOH/g, and most desirably from 70 to 150 mgKOH/g. If the hydroxyl group value is less than 50 mgKOH/g then it is possible that the adhesion of the paint film will be poor, and in those cases where the hydroxyl group value exceeds 200 mgKOH/g it is possible that the paint film will be brittle. There is no particular requirement in terms of the acid value of said acrylic resin.

The weight average molecular weight of the acrylic resin is preferably from 1,000 to 30,000, and more desirably from 2,000 to 10,000.

In those cases where the weight average molecular weight of the acrylic resin is less than 1,000 it is possible that the drying properties will be unsatisfactory, and in those cases where it exceeds 30,000 it is possible that the coating operability will be poor.

Moreover, the abovementioned weight average molecular weight is the value calculated on the polystyrene basis measured with the gel permeation chromatography method (GPC method).

The acrylic resins used in the invention can be produced generally by copolymerizing in the usual ways known in the past hydroxyl group-containing ethylenic unsaturated monomers, alkyl ester-based ethylenic unsaturated monomers and other copolymerizable ethylenic unsaturated monomers, as required.

At least one type selected from among hydroxyethyl (meth)acrylate, hydroxypropyl (meth)acrylate and the like can be cited as an example of the aforementioned hydroxyl group-containing ethylenic unsaturated monomers, and at least one type selected from among methyl (meth)acrylate, ethyl (meth)acrylate, isopropyl (meth)acrylate, n-butyl (meth)acrylate, 2-ethylhexyl (meth)acrylate, n-decyl (meth) acrylate, isodecyl (meth)acrylate and the like can be cited as an example of the alkyl ester-based ethylenic unsaturated monomers. Glycidyl (meth)acrylate, styrene and the like can be cited as examples of the other copolymerizable ethylenic unsaturated monomers.

Those acrylic resins which contain from 5 to 50 mass %, and more desirably from 10 to 30 mass %, of alkyl ester-based ethylenic unsaturated monomer units which have from 8 to 10 carbon atoms in the molecule are preferred for the acrylic resins which are used in the invention because they improve the leveling properties of the paint and have the effect of heightening the appearance of the paint film.

In those cases where the content of alkyl ester-based ethylenic unsaturated monomer units which have from 8 to 10 carbon atoms in the molecule is less than 5 mass % the smoothness is poor, and it is possible that the appearance of the paint film will be unsatisfactory, and in those cases where it exceeds 50 mass % it is possible that the adhesion properties will be poor.

(The Surfactant)

The surfactants which have the effect of smoothing the sanded part and which are normally used in paints can be used for the surfactants which are used in said gradation agent. Examples include acrylic polymers, vinyl-based polymers, siloxane-based polymers, fluorinated polymers, organic modified polysiloxanes and the like, and one type, or a mixture of two or more types, can be used.

The amount of surfactant included in the gradation agent is preferably from 0.05 to 1 mass %, and most desirably from 0.1 to 0.7 mass %. With a surfactant content of less than 0.05 mass % it is possible that the smoothness will be poor, and in those cases where it exceeds 1 mass % it is possible that this will have an adverse effect on the appearance.

(The Curing Catalyst)

The curing catalyst which is used in said gradation agent heightens the paint film strength in the clear thin film part and has the effect of improving the polishability, and the acid catalysts, metal catalysts, and preferably the tin-based catalysts, which promote the reaction of hydroxyl groups with isocyanate compounds can be cited as examples. The curing catalyst is used to promote the reaction of the isocyanate compound in the two-liquid type clear paint and the hydroxyl groups in the acrylic resin in the gradation agent, but no isocyanate curing agent needs to be included in the gradation agent since the amount of acrylic resin in the gradation agent is not great.

The amount of curing catalyst included in the gradation agent is preferably from 0.1 to 2 mass %, and most desirably from 0.2 to 1 mass %. With an amount of curing catalyst which is less than 0.1 mass % it is possible that the adhesion properties will be poor, and in those cases where it exceeds 2 mass % it is possible that the paint film appearance will be poor.

(The Mixing Proportions of Clear Paint and Gradation Agent)

In this invention the mixing proportions of clear paint and gradation agent have an effect on the film thickness at the boundary of the spot repair part and the unrepaired part and the mist state, and mixing proportions as a ratio by mass of from 100/100 to 1/100, more desirably from 90/20 to 5/95, and most desirably of from 80/20 to 10/90, are preferred.

In those cases where the clear paint in the mixing proportions with the gradation agent exceeds 100/100 the polishing operability may deteriorate, and in those cases where it is smaller than 1/100 the appearance of the paint film may deteriorate.

Painting the mixture of clear paint and gradation agent is generally carried out with the spray painting method with an air sprayer or the like.

[Process (f)]

Process (f) in the method of spot repair of this invention is a drying process, and the drying conditions generally used in the automobile repair painting process can be adopted. For example, natural drying or forced drying at some 50 to 80° C. may be used. The usual conditions for the drying time in the case of natural drying are from 8 to 24 hours and in the case of forced drying the usual conditions are from 10 minutes to 60 minutes. In this invention forced drying at a temperature of from 60 to 80° C. for from 45 to 60 minutes is preferred.

[Process (g)]

Process (g) in the method of spot repair of this invention is a process in which the part which has been gradation painted is polished.

The process in which the part which has been gradation painted is polished is a process in which the boundary of the spot repair part and the unrepaired part is smoothed, and it is a process which is generally carried out in automobile repair. Surface adjustment is carried out with a fine compound and then an intermediate finish is carried out with a very fine compound and finally finishing is carried out with an ultra-fine compound.

EXAMPLES

Next the invention will be described in more detail by means of illustrative examples, but the invention is not limited by these examples.

Production Example 1 Synthesis of Acrylic Resin A-1

Xylene (47.5 parts by mass) was introduced into a four-necked flask which had been furnished with a thermometer, a reflux condenser, a stirrer and a dropping funnel and heated while being stirred under a current of nitrogen and maintained at 140° C. Next a dripping component in which ethylenic unsaturated monomer comprising 5 parts by mass styrene, 5 parts by mass n-butyl acrylate, 15 parts by mass n-butyl methacrylate, 10 parts by mass 2-ethylhexyl methacrylate and 15 parts by mass 2-hydroxyethyl methacrylate, and 1.4 parts by mass of t-butyl peroxybenzoate as polymerization initiator, had been uniformly mixed was added dropwise at a constant rate from the dropping funnel over a period of 2 hours at 140° C. After the drip feed had been completed the temperature was maintained at 140° C. for 1 hour and then the reaction temperature was lowered to 110° C. Subsequently a polymerization initiator solution where 0.1 part by mass of t-butyl peroxybenzoate had been dissolved in 1 part by mass of xylene was added as supplementary polymerization initiator and the reaction was completed by maintaining the temperature at 110° C. for 2 hours, and the acrylic resin solution A-1 was obtained. The resin hydroxyl group value of the resin solution A-1 obtained was 129 mgKOH/g, the involatile fraction was 50.0 mass % and the weight average molecular weight measured using gel permeation chromatography (GPC) was 6,200. The amounts of each component introduced are shown in Table 1.

Production Example 2 Synthesis of Acrylic Resin A-2

The synthesis of acrylic resin A-2 was carried out with the same method of synthesis as for acrylic resin A-1 except that the monomer composition was changed to that shown in Table 1. The resin hydroxyl group value of the resin solution A-1 obtained was 129 mgKOH/g, the involatile fraction was 50.0 mass % and the weight average molecular weight measured using gel permeation chromatography (GPC) was 6,100.

TABLE 1

| | | Acrylic Resin | |
|---|---|---|---|
| | | A-1 | A-2 |
| Polymerization Solvent | Xylene | 48.5 | 48.5 |
| Polymerization Initiator | 5-Butyl Peroxybenzoate | 1.5 | 1.5 |
| Monomer | Styrene | 5 | 7.5 |
| | n-Butyl Acrylate | 5 | 10 |
| | n-Butyl Methacrylate | 15 | 17.5 |
| | 2-Ethylhexyl Methacrylate | 10 | — |
| | 2-Hydroxyethyl methacrylate | 15 | 15 |
| Total Amount Introduced (parts by mass) | | 100 | 100 |

Production Example 3

Preparation of Gradation Agents A to F

The raw materials shown in Table 2 were introduced little by little in order, with stirring, in the compounded amounts shown into a reactor which had been furnished with a stirrer and, when the introduction had been completed, the stirring was continued until the mixture was uniform and the gradation agents A to F were obtained.

TABLE 2

| | Gradation agent | | | | | |
|---|---|---|---|---|---|---|
| | A | B | C | D | E | F |
| Xylene | 29 | 14 | 29 | 34 | 39 | 50 |
| Butyl Acetate | 40 | 40 | 40 | 45 | 50 | 49 |
| Ethyl Ethoxypropionate | 20 | 40 | 20 | 20 | — | — |
| Silicone-based Leveling Agent | 0.8 | 0.8 | 0.8 | 0.8 | 0.8 | 0.8 |
| Dibutyltin dilaurate | 0.2 | 0.2 | 0.2 | 0.2 | 0.2 | 0.2 |
| Acrylic Resin A-1 | 10 | 5 | — | — | 10 | — |
| Acrylic Resin A-2 | — | — | 10 | — | — | — |
| Total Amount Introduced (parts by mass) | 100 | 100 | 100 | 100 | 100 | 100 |

Example 1

For the painted object used, cationic electro-deposition paint (CathoGuard 500, a cationic electro-deposition paint produced by the BASF Coatings Japan Ltd.) was painted in such a way as to provide a dry film thickness of 25 μm on a steel sheet, which had been subjected to a chemical forming treatment, and baked for 20 minutes at 170° C. to form an electro-deposited paint film and then a mid-coat paint (trade name Hiepico No. 560, produced by the BASF Coatings Japan Ltd.) was air spray painted in such a way as to provide a dry film thickness of 30 μm and baked at 140° C. for 30 minutes to form a mid-coat paint film. Aqua BC-3, (produced by the BASF Coatings Japan Ltd.) was then applied as a black base paint in such a way as to provide a dry film thickness of 15 μm and a clear paint which had excellent scratch resistance (Progloss N-1000 Clear, produced by the BASF Coatings Japan Ltd.) was applied wet-on-wet in such a way as to provide a film thickness of 40 μm and baked at 140° C. for 30 minutes.

First of all a subject part for repair was wet-sanded using #1000 sanding material to the depth of the deposition. Then the outside of the part which formed the subject of the repair was wet-sanded using Valex Black (corresponding to #3000 sanding material, produced by the Covax Co.).

Water-based base coat paint for repair purposes (Onix HD, produced by the BASF Coatings AG Co.) was painted on the part which was the subject of the repair in such a way as to conceal the base with a thickness of 20 μm. Subsequently scratch-resistant clear paint for repair purposes (Supremelux CP Clear, produced by the BASF Coatings SAS Co.) was painted wet-on-wet on the part which was the subject of the repair in such a way as to provide a film thickness of 50 μm. Then the outside of the part which was the subject of the repair was painted with a mixed solution in which Supremelux CP Clear and the abovementioned Gradation agent A had been mixed together in proportions by mass of 10/100 in such a way that it merged with the mist produced in the previous process while producing little fresh mist on the outside with a gradual reduction from the repair part to the unrepaired part.

Next it was dried for 30 minutes at 60° C. and then dried for 15 minutes at 80° C. The steel sheet was cooled to room temperature and then polished in the order surface adjustment, intermediate finish and final finish to complete the repair paint film. The surface adjustment involved polishing by wool buffing using Dynamite Cut 5936 (produced by the 3M Co.) for the compound. The intermediate finish involved polishing with a hard sponge using Dryzacto Finish 596 (produced by the 3M Co.) for the compound. The final finish involved polishing with a soft sponge using Dryzacto Finish Extra Fine 5988 (produced by the 3M Co.) for the compound.

Examples 2 and 3 and Comparative Examples 1 to 3

These were carried out in the same way as in Example 1 except that the Gradation agent A in Example 1 was changed to the Gradation agent indicated in Table 2.

The appearance of the partially repaired paint films produced in Examples 1 to 3 and Comparative Examples 1 to 3 was evaluated by visual observation of the ease of finding the boundary between the repair paint film of the unrepaired paint film on the basis of the assessment criteria indicated below.

<Assessment Criteria>

◎ : The boundary could not be found in sunlight

○: The boundary could not be found in indoor fluorescent light

Δ: It was difficult to find the boundary in indoor fluorescent light

X: The boundary could be found clearly in indoor fluorescent light.

TABLE 3

| | Example 1 | Example 2 | Example 3 | Comp. Ex. 1 | Comp. Ex. 2 | Comp. Ex. 3 |
|---|---|---|---|---|---|---|
| Type of Gradation agent | A | B | C | D | E | F |
| Appearance of the Partial Repair | ◎ | ◎ | ○ | Δ | Δ | X |

[Potential for Industrial Use]

The method for the spot repair of scratch-resistant paint films of this invention can be applied to the spot repair of scratch-resistant clear paint films on an automobile body and the like, the mist outside the part which is the subject of the repair can be sanded away easily, peeling of the thin film part of the clear paint film is unlikely to arise and it provides an appearance where the boundary of the spot repair part and the unrepaired part is hard to discern.

The invention claimed is:

1. A method for the spot repair of a scratch-resistant paint film comprising:

(a) sanding a part which is the subject of a repair with a sanding material, the part to be repaired having a scratch-resistant clear paint film thereon, (b) sanding a part which is to be clear gradation painted outside the part to be repaired with an abrasive material, (c) painting the part to be repaired with a color base-paint, (d) applying a clear paint wet-on-wet to the part to be repaired without curing the color base-paint, (e) applying a clear paint which has been diluted with a gradation agent to the part which is to be clear gradation painted, (f) drying the painted parts, and (g) polishing the parts which have been gradation painted, wherein (1) the clear paint is a two-liquid paint comprising an isocyanate curing agent; and (2) the gradation agent comprises:

a solvent which comprises ethyl ethoxypropionate, wherein the amount of the solvent in the gradation agent is from 90 to 98 mass % and the amount of ethyl ethoxypropionate in the gradation agent is from 5 to 50 mass %;

an acrylic resin, wherein the amount of the acrylic resin in the gradation agent as solid fraction is from 1 to 5 mass %;

a surfactant, wherein the amount of the surfactant in the gradation agent is from 0.05 to 1 mass %; and a curing catalyst which is a metal catalyst, wherein the amount of the catalyst in the gradation agent is from 0.1 to 2 mass %;

wherein the acrylic resin is a copolymer of a hydroxyl group-containing ethylenically unsaturated monomer and one or more alkyl ester-based ethylenically unsaturated monomers, wherein the hydroxyl group-containing ethylenically unsaturated monomer comprises hydroxyethyl (meth)acrylate or hydroxypropyl (meth)acrylate, and the alky ester-based ethylenically unsaturated monomer comprises at least one of: 2-ethylhexyl (meth)acrylate, n-decyl (meth)acrylate, and isodecyl (meth)acrylate; and wherein the acrylic resin has an OH-group value of 50 to 200 mg KOH/g and a weight-average molecular weight of 1,000 to 30,000.

2. The method of claim 1 further comprising (d') applying a clear paint which has been diluted with a diluting solvent between process (d) and process (e).

3. The method of claim 1, wherein the abrasive material is finer than the sanding material.

4. The method claim 1, wherein in (e) a mixing proportion as a ratio by mass in the range of 100/100 to 1/100 of the clear paint to the gradation agent.

5. The method of claim 1, wherein the solvent further comprises butyl acetate.

* * * * *